US012484614B2

(12) United States Patent
Nicolas

(10) Patent No.: US 12,484,614 B2
(45) Date of Patent: Dec. 2, 2025

(54) CARTRIDGE INSERTION SYSTEMS FOR AEROSOL-GENERATING DEVICES

(71) Applicant: PHILIP MORRIS PRODUCTS S.A., Neuchâtel (CH)

(72) Inventor: Frederic Nicolas, Moret-Loing-et-Orvanne (FR)

(73) Assignee: Philip Morris Products S.A., Neuchâtel (CH)

( * ) Notice: Subject to any disclaimer, the term of this patent is extended or adjusted under 35 U.S.C. 154(b) by 490 days.

(21) Appl. No.: 17/781,846

(22) PCT Filed: Dec. 2, 2020

(86) PCT No.: PCT/IB2020/061342
§ 371 (c)(1),
(2) Date: Jun. 2, 2022

(87) PCT Pub. No.: WO2021/111307
PCT Pub. Date: Jun. 10, 2021

(65) Prior Publication Data

US 2023/0000146 A1 Jan. 5, 2023

(30) Foreign Application Priority Data

Dec. 2, 2019 (EP) ..... 19213020

(51) Int. Cl.
*A24F 1/30* (2006.01)

(52) U.S. Cl.
CPC ..... *A24F 1/30* (2013.01)

(58) Field of Classification Search
None
See application file for complete search history.

(56) References Cited

U.S. PATENT DOCUMENTS

| | | | |
|---|---|---|---|
| 8,783,265 | B2 | 7/2014 | Shakouri Moghadam |
| 8,983,282 | B2 | 3/2015 | Bishara |
| 10,561,172 | B2 | 2/2020 | Armoush et al. |

(Continued)

FOREIGN PATENT DOCUMENTS

| | | |
|---|---|---|
| WO | 20170080545 | 5/2017 |
| WO | 20170178931 | 10/2017 |
| WO | 20190003117 | 1/2019 |

OTHER PUBLICATIONS

European Search Report for EP 19213020.1 issued by the European Patent Office Mar. 27, 2020; 7 pgs.

(Continued)

*Primary Examiner* — Philip Y Louie
*Assistant Examiner* — Virginia R Bieger
(74) *Attorney, Agent, or Firm* — Mueting Raasch Group

(57) ABSTRACT

An aerosol-generating device comprises a drawer receivable in a drawer receptacle. The drawer may define a cartridge receptacle to removably receive a cartridge. The cartridge may comprise an aerosol-forming substrate. The drawer may be movable between an open position and a closed position in a first direction. The device may also comprise a heating element configured for heating the aerosol-forming substrate in a cartridge when a cartridge is received in the cartridge receptacle and the drawer is in the closed position. The aerosol-generating device may comprise a shisha device.

14 Claims, 9 Drawing Sheets

(56) References Cited

U.S. PATENT DOCUMENTS

| | | | | |
|---|---|---|---|---|
| 10,721,964 | B2 | 7/2020 | Eng et al. | |
| 2010/0275937 | A1* | 11/2010 | Moghadam | A24F 1/30 131/196 |
| 2011/0155153 | A1* | 6/2011 | Thorens | H05B 3/58 131/329 |
| 2011/0226266 | A1 | 9/2011 | Tao | |
| 2013/0167854 | A1* | 7/2013 | Shin | A24F 40/42 131/329 |
| 2014/0255014 | A1 | 9/2014 | Bishara | |
| 2014/0305447 | A1 | 10/2014 | Saco | |
| 2015/0013696 | A1* | 1/2015 | Plojoux | A61M 15/06 131/328 |
| 2016/0206001 | A1 | 7/2016 | Eng et al. | |
| 2017/0099873 | A1* | 4/2017 | Benjamignan | A24F 1/30 |
| 2017/0251718 | A1 | 9/2017 | Armoush et al. | |
| 2018/0317544 | A1 | 11/2018 | Hagen | |

OTHER PUBLICATIONS

International Search Report and Written Opinion for PCT/IB2020/061342, issued by the European Patent Office on Feb. 11, 2021; 12 pgs.

International Preliminary Report on Patentability for PCT/IB2020/061342, issued Jun. 16, 2022; 7 pages.

* cited by examiner

CARTRIDGE INSERTION SYSTEMS FOR AEROSOL-GENERATING DEVICES

This application is the § 371 U.S. National Stage of International Application No. PCT/IB2020/061342, filed 2 Dec. 2020, which claims the benefit of European Application No. 19213020.1, filed 2 Dec. 2019.

This disclosure relates to aerosol-generating devices and to cartridges containing an aerosol-forming substrate for use in aerosol-generating devices and, more particularly, to cartridge insertion systems for use in aerosol-generating devices.

Traditional shisha devices are used to smoke tobacco and are configured such that vapor and smoke pass through a water basin before inhalation by a consumer. Shisha devices may include one outlet, or more than one outlet so that the device may be used by more than one consumer at a time. Use of shisha devices is considered by some to be a leisure activity and a social experience.

Typically, traditional shishas are used in combination with a substrate, sometimes referred to in the art as hookah tobacco, tobacco molasses, or simply as molasses. Traditional shisha substrates are relatively high in sugar (in some cases, up to ~50% vs. the ~20% typically found in conventional tobacco substrates, such as in combustible cigarettes). The tobacco used in shisha devices may be mixed with other ingredients to, for example, increase the volume of the vapor and smoke produced, to alter flavor, or both.

Traditional shisha devices employ charcoal, such as charcoal pellets to heat and sometimes combust the tobacco substrate to generate an aerosol for inhalation by a user. Using charcoal to heat the tobacco may cause full or partial combustion of the tobacco or other ingredients. Additionally, charcoal may generate harmful or potentially harmful products, such as carbon monoxide, which may mix with the shisha vapor and pass through the water basin to the outlet.

One way to reduce the production of carbon monoxide and combustion by-products is to employ e-liquids rather than tobacco. Shisha devices that employ e-liquids eliminate combustion by-products but deprive shisha consumers of the traditional tobacco-based experience.

Other shisha devices have been proposed that employ electric heaters to heat, but not combust, tobacco. Such electrically heated heat-not-burn shisha devices heat the tobacco substrate to a temperature sufficient to produce an aerosol from the substrate without combusting the substrate, and therefore reduce or eliminate by-products associated with combustion of tobacco.

Shisha devices may employ a cartridge for housing an aerosol-forming substrate. The cartridge may be filled with such aerosol-forming substrate. The aerosol-forming substrate may comprise tobacco, preferably shisha substrate, such as molasses—a mixture of tobacco, water, sugar, and other components, such as glycerine, flavors, etc. The heating system of the electrically heated shisha device heats the contents of the cartridge to generate aerosol, which is conveyed through an airflow path to a user.

In order to facilitate airflow through the cartridge and the flow of the aerosol from the cartridge, a shisha cartridge may have one or more holes through one or more walls. The cartridge may include one or more holes at the top, one or more holes at the bottom, or both one or more holes at the top and one or more holes at the bottom. Alternatively, the top may be open, that is, the top wall may be partially or completely absent. Any holes or openings in the top and bottom walls may be closed by a removable (for example, peelable) sealing layer, such as a film, sticker, or liner, during storage. The removable layer may protect the contents (for example, the molasses) from exposure to air and oxygen. The removable layer may be removed (for example, pulled or peeled off) by a user prior to first use of the cartridge.

Shisha devices may be described as having a main longitudinal axis. Shisha substrates of cartridges are typically inserted longitudinally into the top part of the shisha device into a heating chamber. In order to efficiently heat the cartridge, a heating element should be positioned very close to the cartridge or in contact with the cartridge. When a user finishes using a cartridge, the cartridge is often immediately extracted from the shisha device and may be replaced by a new cartridge. If a new cartridge is not inserted, removing the used cartridge may be beneficial to prevent leakage of the cartridge's contents. The cartridge is typically removed in the reverse of insertion, which may present a risk for the user as the cartridge and its surroundings have been heated to temperatures sufficient to generate aerosol.

It would be desirable to have an insertion system for a shisha device that allows for practical positioning of the cartridge containing shisha substrate for heating and withdrawal of the cartridge to reduce the risk of burns while maintaining effective heating of the cartridge to provide a consistent smoking experience.

Various embodiments of the present disclosure provide aerosol-generating devices having cartridge insertion systems. The cartridge or the heating element may be moved between a first position and a second position. The first position may be a heating position. The first position may be a position for heating during use of the aerosol-generating device. The second position may be a non-heating position. The second position may be a position for retrieval of the cartridge by the user. Cartridge insertion systems may comprise a drawer. Cartridge insertion systems may comprise a heating element. Cartridge insertion systems may comprise a repositioning assembly. I In the heating position, the device may be configured such that a cartridge received therein is spaced from walls of the drawer. Advantageously, this reduces heating of the drawer to facilitate safe withdrawal. The repositioning assembly may move the heating element or the cartridge. The repositioning assembly may be for configured approximating the cartridge and the heating element. The heating element may be flexible.

According to an embodiment of the present disclosure, an aerosol-generating device may comprise a housing. The housing may comprise a drawer receptacle. The device may also comprise a drawer receivable in the drawer receptacle. The drawer may comprise a cartridge receptacle to removably receive a cartridge. The cartridge may comprise an aerosol-forming substrate. The drawer may be movable between an open position and a closed position. The drawer may be movable between the open position and the closed position in a first direction. The device may also comprise a heating element. The heating element may be configured for heating the aerosol-forming substrate in a cartridge. The heating element may be configured for heating the aerosol-forming substrate in a cartridge when a cartridge is received in the cartridge receptacle and the drawer is in the closed position. The aerosol-generating device may comprise a shisha device.

According to another embodiment of the present disclosure, an aerosol-generating device comprises a housing. The housing comprises a drawer receptacle. The device also comprises a drawer receivable in the drawer receptacle. The drawer comprises a cartridge receptacle to removably receive a cartridge. The cartridge comprises an aerosol-forming substrate. The drawer is movable between an open position and a closed position in a first direction. The device also comprises a heating element. The heating element is configured for heating the aerosol-forming substrate. The heating element is configured for heating the aerosol-forming substrate in a cartridge when a cartridge is received in the cartridge receptacle and the drawer is in the closed position.

The drawer may be movably coupled to the housing. The drawer may define a cartridge receptacle for removably receiving the cartridge comprising the aerosol-forming substrate. The drawer may be movable between an open position and a closed position. The drawer may include one or more air flow apertures in fluid communication with the drawer receptacle and the interior of the vessel. A repositioning assembly may approximate a received cartridge and heating element to reduce a distance between the received cartridge and the heating element. The repositioning assembly may move a received cartridge or the heating element into a position for heating. The heating element may be in direct contact with or proximate to the cartridge in the heating position. The aerosol-generating device may be configured to release a spent cartridge from the aerosol-generating device.

The term "aerosol" is used herein to refer to a suspension of solid particles or liquid droplets, or a combination of solid particles and liquid droplets in a gas. The gas may be air. The solid particles or liquid droplets may comprise one or more volatile flavor compounds. Aerosol may be visible or invisible. Aerosol may include vapors of substances that are ordinarily liquid or solid at room temperature. Aerosol may include vapors of substances that are ordinarily liquid or solid at room temperature, in combination with solid particles or in combination with liquid droplets or in combination with both solid particles and liquid droplets. In some embodiments, the aerosol comprises nicotine.

The term "aerosol-forming substrate" is used herein to refer to a material capable of releasing one or more volatile compounds that can form an aerosol. In some embodiments, an aerosol-forming substrate may be heated to volatilize one or more components of the aerosol-forming substrate to form an aerosol. In some cases, volatile compounds may be released by a chemical reaction or by mechanical stimulus, such as ultrasound. The aerosol-forming substrate may be disposed inside the cartridge. Aerosol-forming substrate may be solid or liquid or may comprise both solid and liquid components. Aerosol-forming substrate may be adsorbed, coated, impregnated or otherwise loaded onto a carrier or support. Aerosol-forming substrate may comprise nicotine. Aerosol-forming substrate may comprise plant-based material. Aerosol-forming substrate may comprise tobacco. Aerosol-forming substrate may comprise a tobacco-containing material containing volatile tobacco flavour compounds, which are released from the aerosol-forming substrate upon heating. Aerosol-forming substrate may alternatively comprise a non-tobacco-containing material. Aerosol-forming substrate may comprise homogenised plant-based material. Aerosol-forming substrate may comprise homogenised tobacco material. Aerosol-forming substrate may comprise at least one aerosol-former. Aerosol-forming substrate may comprise other additives and ingredients, such as flavourants.

The term "heating position" is used herein to refer to a position of a component of the aerosol-generating device to facilitate heating of the aerosol-forming substrate by a heating element. In some embodiments, the heating position may refer to the position of the cartridge receptacle (and therefore to the aerosol-forming substrate in the cartridge), the position of the heating element, or both the positions of the cartridge receptacle and the heating element. For example, when the cartridge receptacle and the heating element are in their respective heating positions, the heating element may be in contact with or proximal to a cartridge in the cartridge receptacle.

The terms "coupled" or "connected" refer to elements being attached to each other either directly (in direct contact with each other) or indirectly (having one or more elements between and attaching the two elements). Either term may be modified by "operatively" and "operably," which may be used interchangeably, to describe that the coupling or connection is configured to allow the components to interact to carry out functionality.

As used here in "to approximate" means to bring together or to bring components closer to one another so as to reduce a distance between said components.

The terms "integral" and "integrally formed" are used herein to describe elements that are formed in one piece (a single, unitary piece). Integral or integrally formed components may be configured such that they cannot be separably removed from each other without causing structural damage to the piece.

As used herein, the singular forms "a," "an," and "the" also encompass embodiments having plural referents, unless the content clearly dictates otherwise.

As used herein, "or" is generally employed in its sense including "one or the other or both" unless the content clearly dictates otherwise.

The term "about" is used herein in conjunction with numeric values to include normal variations in measurements as expected by persons skilled in the art and is understood have the same meaning as "approximately" and to cover a typical margin of error.

As used herein, "have," "having," "include," "including," "comprise," "comprising" or the like are used in their open-ended sense, and generally mean "including, but not limited to". It will be understood that "consisting essentially of," "consisting of," and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the disclosure, including the claims.

The term "substantially" as used herein can be understood to modify the term that follows by at least about 90%, at least about 95%, or at least about 98%. The term "not substantially" as used herein can be understood to have the inverse meaning of "substantially," i.e., modifying the term that follows by not more than 10%, not more than 5%, or not more than 2%.

Any direction referred to herein, such as "top," "bottom," "left," "right," "upper," "lower," and other directions or orientations are described herein for clarity and brevity but are not intended to be limiting of an actual device or system. Devices and systems described herein may be used in a number of directions and orientations.

The aerosol-generating element may comprise a cartridge insertion system. The cartridge insertion system may comprise a drawer. The cartridge insertion system may comprise a heating element or a connection to a heating element. The cartridge insertion system may comprise a drawer. The cartridge insertion system may comprise a repositioning assembly. The repositioning assembly may be configured approximate the heating element and the cartridge. That is, the repositioning assembly may be configured to move one or both of the heating element and the cartridge toward one another. For example, the repositioning assembly may be configured to approximate the heating element and the cartridge receptacle in which a cartridge may be received. That is, the repositioning assembly may be configured to move one or both of the heating element and the cartridge receptacle, in which a cartridge may be received, toward one another.

A drawer receptacle may be formed in a housing of the aerosol-generating device to receive the drawer. In some embodiments, the housing may be part of an aerosol-generating element of the aerosol-generating device. The aerosol-generating element may be coupled to a vessel, for example, via a conduit to provide aerosol to a user through the vessel.

The cartridge may comprise any suitable body defining a cavity. Aerosol-forming substrate may be disposed in the cavity of the cartridge. The body is preferably formed from one or more heat resistant materials, such as a heat resistant metal or polymer. The body may comprise a thermally conductive material. For example, the body may comprise any of aluminum, copper, zinc, nickel, silver, any alloys thereof, and combinations thereof. Preferably, the body comprises aluminum.

The cartridge may be of any suitable shape. For example, the cartridge may have a shape configured to be received by an aerosol-generating device, such as a shisha device. The cartridge may have a substantially cuboidal shape, cylindrical shape, frustoconical shape, or any other suitable shape. Preferably, the cartridge has a generally cylindrical shape or an asymmetrical shape, such as a frustoconical shape.

Any suitable aerosol-forming substrate may be provided in the cavity defined by the body of the cartridge. The aerosol-forming substrate is preferably a substrate capable of releasing volatile compounds. The aerosol-forming substrate is preferably a substrate capable of releasing compounds that may form an aerosol. The volatile compounds may be released by heating the aerosol-forming substrate. The volatile compounds may be released by a chemical reaction or by a mechanical stimulus, such as ultrasound. Aerosol-forming substrate may be solid or liquid or may comprise both solid and liquid components. Aerosol-forming substrate may be adsorbed, coated, impregnated or otherwise loaded onto a carrier or support.

The aerosol-forming substrate may comprise nicotine. The nicotine containing aerosol-forming substrate may comprise a nicotine salt matrix. The aerosol-forming substrate may comprise plant-based material. The aerosol-forming substrate preferably comprises tobacco. The tobacco containing material preferably comprises volatile tobacco flavor compounds, which are released from the aerosol-forming substrate upon heating. The aerosol-forming substrate may comprise homogenized tobacco material. Homogenized tobacco material may be formed by agglomerating particulate tobacco. The aerosol-forming substrate may alternatively or additionally comprise a non-tobacco-containing material. The aerosol-forming substrate may comprise homogenized plant-based material. Aerosol-forming substrate may comprise at least one aerosol-former. Aerosol-forming substrate may comprise other additives and ingredients, such as flavorants. Preferably, the aerosol-forming substrate is a shisha substrate. A shisha substrate is understood to mean a consumable material that is suitable for use in a shisha device. Shisha substrate may include molasses.

The aerosol-forming substrate may include, for example, one or more of: powder, granules, pellets, shreds, spaghettis, strips, or sheets. The aerosol-forming substrate may contain one or more of: herb leaf, tobacco leaf, fragments of tobacco ribs, reconstituted tobacco, homogenized tobacco, extruded tobacco, and expanded tobacco.

The aerosol-forming substrate may include at least one aerosol former. Suitable aerosol formers include compounds or mixtures of compounds which, in use, facilitate formation of a dense and stable aerosol and which are substantially resistant to thermal degradation at the operating temperature of the shisha device. Suitable aerosol formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine. The aerosol-forming substrate may include any suitable amount of an aerosol former. For example, the aerosol former content of the substrate may be equal to or greater than 5% on a dry weight basis, and preferably greater than 30% by weight on a dry weight basis. The aerosol former content may be less than about 95% on a dry weight basis. Preferably, the aerosol former content is up to about 55%.

The aerosol-forming substrate preferably includes nicotine and at least one aerosol former. In some embodiments, the aerosol former is glycerine or a mixture of glycerine and one or more other suitable aerosol formers, such as those listed above.

The aerosol-forming substrate may include other additives and ingredients, such as flavorants, sweeteners, etc. In some examples, the aerosol-forming substrate includes one or more sugars in any suitable amount. Preferably, the aerosol-forming substrate includes invert sugar. Invert sugar is a mixture of glucose and fructose obtained by splitting sucrose. Preferably, the aerosol-forming substrate includes from about 1% to about 40% sugar, such as invert sugar, by weight. In some example, one or more sugars may be mixed with a suitable carrier such as cornstarch or maltodextrin.

In some examples, the aerosol-forming substrate includes one or more sensory-enhancing agents. Suitable sensory-enhancing agents include flavorants and sensation agents, such as cooling agents. Suitable flavorants include natural or synthetic menthol, peppermint, spearmint, coffee, tea, spices (such as cinnamon, clove, ginger, or combination thereof), cocoa, vanilla, fruit flavors, chocolate, eucalyptus, geranium, eugenol, agave, juniper, anethole, linalool, and any combination thereof.

In some examples, the aerosol-forming substrate is in the form of a suspension. For example, the aerosol-forming substrate may include molasses. As used herein, "molasses" means an aerosol-forming substrate composition comprising about 20% or more sugar. For example, the molasses may include at least about 25% by weight sugar, such as at least about 35% by weight sugar. Typically, the molasses will contain less than about 60% by weight sugar, such as less than about 50% by weight sugar.

Any suitable amount of aerosol-forming substrate (for example, molasses or tobacco substrate) may be disposed in the cavity. In some preferred embodiments, about 3 g to about 25 g of the aerosol-forming substrate is disposed in the cavity. The cartridge may include at least 6 g, at least 7 g, at least 8 g, or at least 9 g of aerosol-forming substrate. The cartridge may include up to 15 g, up to 12 g; up to 11 g, or up to 10 g of aerosol-forming substrate. Preferably, from about 7 g to about 13 g of aerosol-forming substrate is disposed in the cavity.

The aerosol-forming substrate may be provided on or embedded in a thermally stable carrier. The term "thermally stable" is used herein to indicate a material that does not substantially degrade at temperatures to which the substrate is typically heated (e.g., about 150° C. to about 300° C.). The carrier may comprise a thin layer on which the substrate deposited on a first major surface, on second major outer surface, or on both the first and second major surfaces. The carrier may be formed of, for example, a paper, or paper-like material, a non-woven carbon fiber mat, a low mass open mesh metallic screen, or a perforated metallic foil or any other thermally stable polymer matrix. Alternatively, the carrier may take the form of powder, granules, pellets, shreds, spaghettis, strips or sheets. The carrier may be a non-woven fabric or fiber bundle into which tobacco components have been incorporated. The non-woven fabric or fiber bundle may comprise, for example, carbon fibers, natural cellulose fibers, or cellulose-derivative fibers.

The body of the cartridge may include one or more walls. In some embodiments, the body includes a top wall, a bottom wall, and a lateral wall. The lateral wall may be cylindrical or frustoconical, extending from the bottom to the top. The body may include one or more parts. For example, the lateral wall and the bottom wall may be an integral single part. The lateral wall and the bottom wall may be two parts configured to engage one another in any suitable manner. For example, the lateral wall and the bottom wall may be configured to engage one another by threaded engagement or interference fit. The lateral wall and the bottom wall may be two parts joined together. For example, the lateral wall and the bottom wall may be joined together by welding or by an adhesive. The top wall and lateral wall may be a single integral part. The lateral wall and the top wall may be two parts configured to engage one another in any suitable manner. For example, lateral wall and the top wall may be configured to engage one another by threaded engagement or interference fit. The lateral wall and the top wall may be two parts joined together. For example, the lateral wall and the top wall may be joined together by welding or by an adhesive. The top wall, lateral wall and bottom wall may all be a single integral part. The top wall, the lateral wall, and the bottom wall may be three separate parts configured to engage one another in any suitable manner. For example, the top wall, the lateral wall, and the bottom wall may be configured to engage by threaded engagement interference fit, welding, or an adhesive.

One or more walls of the body may form a heatable wall or surface. As used herein, "heatable wall" and "heatable surface" mean an area of a wall or a surface to which heat may be applied, either directly or indirectly. The heatable wall or surface may function as a heat transfer surface through which heat may be transferred from outside of the body to the cavity or to an internal surface of the cavity.

Preferably, the body of the cartridge has a length (for example, an axial length along a vertical center axis) of about 15 cm or less. In some embodiments, the body has a length of about 10 cm or less. The body may have an inside diameter of about 1 cm or more. The inside diameter of the body may be about 1.75 cm or more. The cartridge may have a heatable surface area in the cavity from about 25 $cm^2$ to about 100 $cm^2$, such as from about 70 $cm^2$ to about 100 $cm^2$. The volume of the cavity may be from about 10 $cm^3$ to about 50 $cm^3$; preferably from about 25 $cm^3$ to about 40 $cm^3$. In some embodiments, the body has a length in a range from about 3.5 cm to about 7 cm. The inside diameter of the body may be from about 1.5 cm to about 4 cm. The body may have a heatable surface area in the cavity from about 30 $cm^2$ to about 100 $cm^2$, such as from about 70 $cm^2$ to about 100 $cm^2$. The volume of the cavity may be from about 10 $cm^3$ to about 50 $cm^3$; preferably from about 25 $cm^3$ to about 40 $cm^3$. Preferably, the body is cylindrical or frustoconical.

The cartridge body may include one or more openings or ventilation holes through one or more walls of the body. The ventilation holes may be inlets, outlets, or both. The ventilation holes may be disposed at the bottom wall, top wall, sides, or a combination thereof, of the cartridge. In some embodiments, the cartridge includes one or more inlets and one or more outlets to allow air to flow through the aerosol-forming substrate when the cartridge is used with an aerosol-generating device. In some embodiments, the top wall of the cartridge may be absent or may define one or more openings to form the one or more inlets of the cartridge. The bottom wall of the cartridge may define one or more openings to form the one or more outlets of the cartridge. Preferably, the one or more inlets and outlets are sized and shaped to provide a suitable resistance to draw (RTD) through the cartridge. In some examples, the RTD through the cartridge, from the inlet or inlets to the outlet or outlets, may be from about 10 mm $H_2O$ to about 50 mm $H_2O$, preferably from about 20 mm $H_2O$ to about 40 mm $H_2O$. The RTD of a specimen refers to the static pressure difference between the two ends of the specimen when it is traversed by an air flow under steady conditions in which the volumetric flow is 17.5 milliliters per second at the output end. The RTD of a specimen may be measured using the method set out in ISO Standard 6565:2002.

The one or more openings on the body may cover 5% or greater, 10% or greater, 15% or greater, 20% or greater, or 25% or greater of the area of the wall the openings are on. For example, if the openings are on the top wall, the openings may cover at least 5% of the area of the top wall. The one or more openings on the body may cover 75% or less, 50% or less, 40% or less, or 30% or less of the area of the wall the openings are on.

The cartridge may further include a seal or layer covering the one or more inlets and optionally a second seal or layer covering the one or more outlets prior to use. The cartridge may include a first removable seal covering the one or more inlets and a second removable seal covering the one or more outlets. The first and second seals are preferably sufficient to prevent air flow through the inlets and outlets to prevent leakage of the contents of the cartridge and to extend shelf life. The seal may comprise a peelable label of sticker, foil, or the like. The label, sticker, or foil may be affixed to the cartridge in any suitable manner, such as with an adhesive, crimping, welding, or otherwise being joined to the container. The seal may comprise a tab that may be grasped to peel or remove the label, sticker, or foil from the cartridge.

In some embodiments, the cartridge is a shisha cartridge that may be used with any suitable shisha device. Preferably, the aerosol-generating device is configured to sufficiently heat the aerosol-forming substrate in the cartridge to form an aerosol from the aerosol-forming substrate but not to combust the aerosol-forming substrate. For example, the aerosol-generating device may be configured to heat the aerosol-forming substrate to a temperature in a range from about 150° C. to about 300° C.; more preferably from about 180° C. to about 250° C. or from about 200° C. to about 230° C.

The aerosol-generating device is configured to heat the aerosol-forming substrate in the cartridge. The heating element may be coupled to the housing. In general, the heating element is configured to not touch the drawer during heating.

The heating element may contact one or more walls of the cartridge, such as a top wall, a bottom wall, or a lateral wall of the cartridge. In some embodiments, the heating element may contact two or more walls of the cartridge. For example, the heating element may squeeze or press the cartridge in the heating position.

The device may be configured to heat the aerosol-forming substrate in the cartridge by conduction. The cartridge is preferably shaped and sized to allow contact with, or minimize distance from, a heating element of the aerosol-generating device to provide efficient heat transfer from the heating element to the aerosol-forming substrate in the cartridge. The heat may be generated by any suitable mechanism, such as by resistive heating or by induction. In order to facilitate inductive heating, the cartridge may be provided with a susceptor. For example, the cartridge body may be made from or include a material (for example, aluminum) that is capable of acting as a susceptor, or a susceptor material may be provided within the cavity of the cartridge. A susceptor material may be provided within the cavity of the cartridge in any form, for example a powder, a solid block, shreds, etc.

The heating element may be configured for heating the aerosol-forming substrate in the cartridge when the cartridge is received in the cartridge receptacle and the drawer is in the closed position. The shisha cartridge may be configured to transfer heat from the heating element to the aerosol-forming substrate in the cavity by conduction. In some embodiments, the heating element includes an electric heating element. In some embodiments, the heating element includes a resistive heating component. For example, the heating element may include one or more resistive wires or other resistive elements. The resistive wires may be in contact with a thermally conductive material to distribute heat produced over a broader area. Examples of suitable conductive materials include aluminum, copper, zinc, nickel, silver, and combinations thereof.

The heating element may comprise a flexible material. The heating element comprising the flexible material may be described as a flexible heating element. The heating element may be biased in a particular direction, for example, to contact or be proximate to the cartridge. In some embodiments, the heating element is configured to move into a heating position in response to the drawer moving from the open position to the closed position.

The heating element may be shaped to engage with a surface of the cartridge. In some embodiments, the heating element is contoured to substantially maximize the surface area engagement between the heating element and the cartridge. In some embodiments, the heating element may have a "W" shape. Advantageously, a "W" shape helps the heating element to press on a lateral wall of the cartridge.

The flexible heating element may comprise two or more layers of material. In some embodiments, the flexible heating element may comprise a multi-layer heating strip. For example, the multi-layer heating strip may comprise at least a heating layer and a thermally insulating layer, which may also be described as a high heat resistance layer.

The heating layer may be formed of a thin line of resistance heating material, such as a stainless steel wire, to provide electrical resistance heating. In some embodiments, the heating layer may comprise woven metal wires. In some embodiments, the heating layer may include an array of electrically connected resistive parts on heat resistance flexible film or on spring connected sections.

The high heat resistance layer may comprise a flexible foil having a high heat resistance. For example, the high heat resistance layer may comprise polyimide or polyetheretherketone (PEEK). In some embodiments, the high heat resistance layer may comprise some rigid or deflectable, or spring-like, parts to help bias, or position, the heating layer in direct contact with or proximate to the cartridge in the heating position of the heating element.

The multi-layer heating strip may comprise a third layer. The third layer may be a second high heat resistance layer having low thermal conductivity. In some embodiments, the second high heat resistance layer may have a lower thermal conductivity than the first high heat resistance layer. For example, the second high heat resistance layer may comprise PEEK and the first high heat resistance layer may comprise polyimide.

The first high heat resistance layer having high thermal conductivity may be positioned closer to the cartridge than the second high heat resistance layer having low thermal conductivity, especially when the heating element is in the heating position. In some embodiments, the first high heat resistance layer may be positioned on the opposite side of the heating layer than the second high heat resistance layer, which may be closer to a wall of the drawer. The heating layer may be positioned between the first and second high heat resistance layers.

The flexible heating element may comprise two heating strips, which may be biased to contact or be proximate to the cartridge in the heating position. The two heating strips, which may each be multi-layer heating strips, may squeeze the cartridge in the heating position. The two heating strips may be positioned on opposite sides of the cartridge in the heating position.

Contact of the flexible heating element with the cartridge may be tested, for example, if the cartridge has a conductive exterior. In some embodiments, the conductivity through at least two heating strips of the flexible heating element may be tested to determine whether the flexible contact is in contact with the cartridge. A high conductivity from one heating strip to the other heating strip may indicate contact between each strip and the cartridge, whereas a low conductivity may indicate no contact or poor contact.

In some embodiments, one or more airflow apertures may be formed in the heating element to allow air or aerosol to pass through. For example, airflow apertures may allow air to flow into the cartridge receptacle.

The aerosol-generating device may include control electronics operably coupled to the heating element. The control electronics may be configured to control heating of the heating element. The control electronics may be configured to control the temperature to which the aerosol-forming substrate in the cartridge is heated. The control electronics may be provided in any suitable form and may, for example, include a controller or a memory and a controller. The controller may include one or more of an Application Specific Integrated Circuit (ASIC) state machine, a digital signal processor, a gate array, a microprocessor, or equivalent discrete or integrated logic circuitry. Control electronics may include memory that contains instructions that cause one or more components of the circuitry to carry out a function or capability of the control electronics. Functions attributable to control electronics in this disclosure may be embodied as one or more of software, firmware, and hardware.

The electronic circuitry may include a microprocessor, which may be a programmable microprocessor. The electronic circuitry may be configured to regulate a supply of power. The power may be supplied to the heater element in the form of pulses of electrical current.

In some examples, the control electronics may be configured to monitor the electrical resistance of the heating element and to control the supply of power to the heating element depending on the electrical resistance of the heating element. In this manner, the control electronics may regulate the temperature of the resistive element.

The aerosol-generating device may include a temperature sensor, such as a thermocouple. The temperature sensor may be operably coupled to the control electronics to control the temperature of the heating element. The temperature sensor may be positioned in any suitable location. For example, the temperature sensor may be configured to insert into the cartridge when received within the receptacle to monitor the temperature of the aerosol-forming substrate being heated. In addition or alternatively, the temperature sensor may be in contact with the heating element. In addition or alternatively, the temperature sensor may be positioned to detect temperature at an aerosol outlet of the aerosol-generating device or a portion thereof. The sensor may transmit signals regarding the sensed temperature to the control electronics. The control electronics may adjust heating of the heating elements in response to the signal to achieve a suitable temperature at the sensor.

The control electronics may be operably coupled to a power supply, which may power the heating element. The aerosol-generating device may include any suitable power supply. For example, a power supply of an aerosol-generating device may be a battery or set of batteries. The batteries of the power supply may be rechargeable, removable and replaceable, or rechargeable and removable and replaceable. Any suitable battery may be used. For example, heavy duty type or standard batteries existing in the market, such as used for industrial heavy-duty electrical power-tools. Alternatively, the power supply may be any type of electric power supply including a super or hyper-capacitor. Alternatively, the assembly may be connected to an external electrical power source, and electrically and electronically designed for such purpose. Regardless of the type of power supply employed, the power supply preferably provides sufficient energy for the normal functioning of the assembly for at least one shisha session until aerosol is depleted from the aerosol-forming substrate in the cartridge before being recharged or needing to connect to an external electrical power source. Preferably, the power supply provides sufficient energy for the normal functioning of the assembly for at least about 70 minutes of continuous operation of the device, before being recharged or needing to connect to an external electrical power source.

The aerosol-generating device includes an air inlet channel in fluid connection with the cartridge receptacle. In use, when the substrate inside the cartridge is heated, aerosol former components in the substrate vaporize. Air flowing from the air inlet channel through the cartridge becomes entrained with aerosol generated from the aerosol former components in the cartridge.

Some electrically heated aerosol-generating devices employ pre-heated air and typically employ an airflow path such that the air travels in the vicinity of the heat source upon puffing. Further, some electrically heated aerosol-generating devices employ elements that increase radiation heat transfer by increasing the heated surface area.

The air inlet channel may include one or more apertures through the cartridge receptacle such that air from outside the aerosol-generating device may flow through the channel and into the cartridge receptacle through the one or more apertures. If a channel includes more than one aperture, the channel may include a manifold to direct air flowing through the channel to each aperture. Preferably, the aerosol-generating device includes two or more air inlet channels.

As described above, the cartridge includes one or more openings (such as inlets or outlets) formed in the body, allowing air to flow through the cartridge. If the cartridge receptacle includes one or more inlet apertures, at least some of the inlets in the cartridge may align with the apertures in the top of the cartridge receptacle. In some embodiments, the one or more air inlet apertures are formed in the heating element. The cartridge may include an alignment feature configured to mate with a complementary alignment feature of the cartridge receptacle to align the inlets of the cartridge with the apertures of the cartridge receptacle when the cartridge is inserted into the cartridge receptacle.

Air that enters the cartridge may flow across or through, or both across and through the aerosol-forming substrate, entraining aerosol, and exiting the cartridge and cartridge receptacle via an aerosol outlet. In some embodiments, one or more aerosol outlets may be formed in the drawer, such as a bottom wall of the drawer. From the aerosol outlet, the air carrying the aerosol enters a vessel of the aerosol-generating device.

The aerosol-generating device may define a longitudinal axis. The longitudinal axis may be defined to extend between the housing and the vessel.

The aerosol-generating device may include any suitable vessel defining an interior volume configured to contain a liquid and defining an outlet in a headspace above a liquid fill level. The interior volume may be in communication with the cartridge receptacle and the outlet. The vessel may include an optically transparent or opaque housing to allow a consumer to observe contents contained in the vessel. The vessel may include a liquid fill demarcation, such as a liquid fill line. The vessel housing may be formed of any suitable material. For example, the vessel housing may include glass or suitable rigid plastic material. Preferably, the vessel is removable from a portion of the shisha assembly comprising the aerosol-generation element to allow a consumer to fill, empty or clean the vessel.

The vessel may be filled to a liquid fill level by a consumer. The liquid preferably includes water, which may optionally be infused with one or more colorants, flavorants, or colorants and flavorants. For example, the water may be infused with one or both of botanical and herbal infusions.

Aerosol entrained in air exiting the aerosol outlet of the cartridge receptacle may travel through a conduit positioned in the vessel. The conduit may be described as an aerosol conduit. The conduit may convey aerosol from the cartridge receptacle to below the liquid fill level in the vessel. The conduit may be coupled to the aerosol outlet of the aerosol-generating element and may have an opening below the liquid fill level of the vessel, such that aerosol flowing through the vessel flows through the opening of the conduit, then through the liquid, into headspace of the vessel and exits through a headspace outlet, for delivery to a consumer.

The headspace outlet may be coupled to a hose comprising a mouthpiece for delivering the aerosol to a consumer. In particular, the headspace outlet may be in communication with the headspace. The mouthpiece may include an activation element, such as a switch activatable by a user, a puff sensor arranged to detect a user puffing on the mouthpiece, or both a switch activatable by the user and a puff sensor. The activation element is operably coupled to the control electronics of the aerosol-generating device. The activation element may be wirelessly coupled to the control electronics. Activation of the activation element may cause the control electronics to activate the heating element, rather than constantly supplying energy to the heating element. Accordingly, the use of an activation element may serve to save energy relative to devices not employing such elements to provide on-demand heating rather than constant heating.

In some embodiments, the activation element may be activated by moving the drawer to a closed position. For example, a sensor may be embedded in heating element to ensure contact with a cartridge wall before activating. In some embodiments, the activation element may be activated upon detecting that the heating element is in contact with the cartridge.

Any suitable type of sensor may be used. Non-limiting examples include a contact sensor configured to detect a conductive wall of the cartridge to close an electrical circuit or an optical sensor to detect a distance to the cartridge wall.

For purposes of example, one method for using an aerosol-generating device as described herein is provided below in chronological order. The vessel may be detached from other components of the aerosol-generating device and filled with water. One or more of natural fruit juices, botanicals, and herbal infusions may be added to the water for flavoring. The amount of liquid added should cover a portion of the conduit but should not exceed a fill level mark that may optionally exist on the vessel. The vessel is then reassembled to the aerosol-generating device. The cartridge may be prepared by removing any removable layer (if present). A portion of the aerosol-generating element may be opened to allow the cartridge to be inserted into the cartridge receptacle. In particular, the drawer may be moved to an open position to receive the cartridge. The drawer may be moved to the closed position to close the aerosol-generating element. One or both of the cartridge and the heating element are repositioned to bring the heating element and the cartridge in contact or proximate to one another.

The device may be turned on. Turning on the device may initiate a heating profile of a heating element, to heat the aerosol-forming substrate to a temperature at or above a vaporization temperature but below a combustion temperature of the aerosol-forming substrate. The aerosol forming compounds of the aerosol-forming substrate vaporize, generating an aerosol. The user may puff on the mouthpiece as desired. The user may continue using the device as long as desired or until no more aerosol is visible or being delivered. In some embodiments, the device may be arranged to automatically shut off when the cartridge or a compartment of the cartridge is depleted of usable aerosol-forming substrate. In some embodiments, the consumer may refill the device with a new cartridge after, for example, receiving the cue from the device that the aerosol-forming substrate in the cartridge is depleted or nearly depleted. The aerosol-generating device may be turned off at any time by a consumer by, for example, switching off the device.

The aerosol-generating device may have any suitable air management. In one example, puffing action from the user will create a suction effect causing a low pressure inside the device which will cause external air to flow through an air inlet of the device, into the air inlet channel, and into the cartridge receptacle. The air may then flow through the cartridge in the cartridge receptacle and become entrained with aerosol produced from the aerosol-forming substrate. The air with entrained aerosol then exits the aerosol outlet of the cartridge receptacle, flows through the conduit to the liquid inside the vessel. The aerosol will then bubble out of the liquid and into headspace in the vessel above the level of the liquid, out the headspace outlet, and through the hose and mouthpiece for delivery to the consumer. The flow of external air and the flow of the aerosol inside the aerosol-generating device may be driven by the action of puffing from the user.

In general, the aerosol-generating device may be configured to move at least one of the heating element and the cartridge when the cartridge is received in the cartridge receptacle in a repositioning direction to reduce a distance between the heating element and the cartridge in response to moving the drawer from the open position to the closed position. In some embodiments, the repositioning direction may be different than the first direction corresponding to moving the drawer from the open position to the closed position, different than another direction corresponding to moving the drawer from the closed position to the open position, or different than both the first direction and the another direction.

The repositioning assembly may be coupled to the heating element, the cartridge, or both the heating element and the cartridge. A repositioning assembly coupled to the heating element may be described as a heating element repositioning assembly. A repositioning assembly coupled to the cartridge may be described as a cartridge repositioning assembly.

The repositioning assembly may be configured to move the heating element, the cartridge, or both the heating element and the cartridge. In some embodiments, the repositioning assembly may move at least one of the heating element and the cartridge in the repositioning direction to approximate, or reduce a distance between, the heating element and the cartridge. The repositioning assembly may move at least one of the heating element and the cartridge in response to movement of the drawer. In some embodiments, the repositioning assembly may position the heating element in contact with or proximate to the cartridge, position the cartridge in contact with or proximate to the heating element, or position both the heating element and the cartridge in contact with or proximate to one another. For example, the repositioning assembly may be configured to move the heating element into a heating position that is in contact with or proximate to the cartridge in response to the drawer moving from the open position to the closed position. The repositioning assembly may be biased, for example, using a spring, to move the heating element and the cartridge away from each other in response to the drawer moving from the closed position to the open position.

In some embodiments, the repositioning assembly may be configured to rotate the heating element into contact with or in proximity to the cartridge, linearly translate the heating element into contact with or in proximity to the cartridge, or both rotate the heating element and linearly translate the heating element, which may bring the heating element into contact with or in proximity to the cartridge.

The repositioning assembly may use mechanical motion of the drawer to power movement of the heating element or uses sensor data to initiate movement of the heating element. In other words, the repositioning may utilize a mechanical mechanism to convert the mechanical power from opening or closing the drawer to initiate or power movement of the heating element, the cartridge, or both the heating element and the cartridge in the repositioning direction.

In some embodiments, the repositioning assembly may comprise a first arm positioned in the path of the drawer, a second arm coupled to the heating element, and a pivot joint, which may be described as an axle, coupled to the housing between the first arm and the second arm. The drawer may push the first arm when moving from the open position to the closed position to rotate the second arm about the pivot joint, which may move the heating element toward the cartridge and into the heating position. The pivot joint may maintain the same or substantially the same angle between the first and second arms. The repositioning assembly may be biased, for example, using a spring, such that when the drawer is moved from the closed position to the open position, the second arm rotates about the pivot joint to move the heating element away from the cartridge and into a non-heating position.

In some embodiments, repositioning assembly may include a presence sensor configured to sense, or capture, the position of the drawer and a piston assembly configured to reposition the heating element in a direction orthogonal to the first direction. The presence sensor may include any suitable sensor, such as a laser sensor, an infrared (IR) sensor, or a Hall effect sensor. Activation of the sensor may trigger the piston to push the heating element toward the cartridge and into the heating position. The piston assembly may include a pressure sensor to stop movement of the piston of the piston assembly in response to a sufficient amount of pressure being placed on the cartridge by the heating element. In some embodiments, the movement of the drawer in the first direction toward the closed position may be described as a lateral movement, whereas movement of the piston and the heating element may be described as longitudinal movement.

In some embodiments, the repositioning assembly includes one or more gears. The drawer may include a gear-like surface connected to a rotating axle having mating female gears. The axle may have a threaded connection with a cantilever connected to the heating element. The cantilever may be prevented from rotating, for example, by being connected to a fixed tube going through it. Moving the drawer from the open position to the closed position may rotate the axle, which may cause the cantilever and the heating element coupled to the cantilever to move closer to the cartridge. Moving the drawer from the closed position to the open position may cause the cantilever and the heating element to move away from the cartridge. In some embodiments, the movement of the drawer in the first direction toward the closed position may be described as a lateral movement, whereas movement of the cantilever and the heating element may be described as longitudinal movement.

In some embodiments, the repositioning assembly includes one or more selective spacing elements used with a flexible heating element. The one or more selective spacing elements may be configured to allow the heating element to move into the heating position when the drawer is in the closed position and to move the heating element away from the cartridge when the drawer is in the open position.

The repositioning assembly may comprise a platform. The platform may be extendable into the cartridge receptacle to move the cartridge from the cartridge receptacle into a heating position, for example, when the drawer is moved from the open position to the closed position. The cartridge may be received into the drawer receptacle on the platform. The platform may move the cartridge closer to the heating element, for example, when the heating element is positioned in a heating chamber outside of the cartridge receptacle or even outside of the drawer. The repositioning assembly may move the cartridge at least partially into the heating chamber when the drawer is in the closed position. In some embodiments, the cartridge may be moved vertically, or along the longitudinal axis, upward or downward, to position the cartridge at least partially in the heating chamber. The repositioning assembly may include a fixed cam, or guiding ramp, coupled to the housing, a rail coupled to the platform and slidably coupled to the fixed cam, and a pivot joint coupled to the rail and to the drawer. Moving the drawer from the open position to the closed position may cause the rail to slide along the fixed cam and to move the platform toward the heating chamber. A first end of the rail may slide down along the fixed cam, which may generate lift at a second end of the rail coupled to the platform.

The repositioning assembly may be operably coupled to the control electronics. The control electronics may be used to initiate movement of the repositioning assembly.

The aerosol-generating device, which may be or include a shisha device, may include the cartridge receptacle for receiving the cartridge. The cartridge may be removably received into the cartridge receptacle. The aerosol-generating device may include a heating element configured to contact or to be in proximity to the body of the cartridge when the cartridge is received in the receptacle. In particular, the aerosol-generating device may be configured to move the cartridge relative to the heating element or to move the heating element relative to the cartridge to bring the heating element in contact or in proximity with the body of the cartridge.

The aerosol-generating device may include a drawer defining the cartridge receptacle. The drawer may be opened or closed. In particular, the drawer may be moved between an open position and a closed position. The drawer may be moved in a first direction from the open position to the closed position. The drawer may be moved in another direction from the closed position to the open position.

The drawer may be formed of any suitable material. In some embodiments, the drawer may be formed of a thermal insulating material.

The first direction may be different than a direction along the longitudinal axis defined by the aerosol-generating device. In some embodiments, the first direction may be orthogonal to the longitudinal axis. Movement in the first direction may be described as movement along a lateral axis.

In some embodiments, the cartridge receptacle of the drawer may be configured to receive the cartridge in a second direction when the drawer is in the open position. The second direction may be different to the first direction. In some embodiments, the second direction may be orthogonal to the first direction.

The aerosol-generating device may permit the cartridge to be released from the cartridge receptacle of the drawer. In some embodiments, the cartridge may optionally be released from the cartridge receptacle in response to moving the drawer from the closed position to the open position.

The shape of an interior of the cartridge receptacle may be complementary to the shape of an exterior of the cartridge. In some embodiments, the cartridge receptacle may have an interior defining an asymmetrical shape. One example of an asymmetrical shape is a frustoconical shape. The asymmetrical shape may facilitate a particular position or orientation of the cartridge when the cartridge is received in the cartridge receptacle.

In one example, an aerosol-generating device includes an aerosol-generating element that includes a cartridge receptacle, a heating element, an aerosol outlet, and an air inlet. The cartridge receptacle is configured to receive a cartridge according to the present disclosure containing the aerosol-forming substrate.

The drawer may comprise one or more lateral walls and a bottom wall. The drawer may optionally comprise a top wall. The one or more lateral walls may include one or more side walls.

The drawer may be movably coupled to the housing of the aerosol-generating device and, in particular, to the housing of the aerosol-generating element. The housing may comprise a drawer receptacle. The drawer may be receivable into the drawer receptacle of the housing.

The drawer may be manually opened or closed. The opening and closing of the drawer may also be assisted or at least partially automatically moved. In some embodiments, the aerosol-generating device may comprise a motor. The motor may be described as a drawer motor. The motor may be coupled to the drawer and to the housing. The motor may be configured to move the drawer from the open position to the closed position or from the closed position to the open position. The motor may be operably coupled to the control electronics. A user may engage a touch-sensitive interface, such as a manual button, or otherwise provide a user input to open or close the drawer.

The aerosol-generating device may comprise a cooling system configured to cool the drawer. The cooling system may be described as a drawer cooling system. The cooling system may be an active cooling system using electrical power. In some embodiments, the cooling system may be activated when the heating element is not activated. The drawer cooling system may comprise a fan, a heatsink, or both a fan and a heatsink.

The drawer may comprise one or more selective spacing elements configured to allow the heating element to move into the heating position when the drawer is in the closed position and to move the heating element away from the cartridge when the drawer is in the open position. For example, the heating element may comprise a flexible material, and the flexible heating element may be biased to move into the heating position. The one or more selective spacing elements may allow the heating element to move into the heating position when the drawer is moved into the closed position and may move the heating element away from the cartridge when the drawer is moved into the open position. In some embodiments, the one or more selective spacing elements may comprise a tapered end to facilitate moving one or more flexible heating elements.

The drawer may comprise one or more open areas, which may be formed in the one or more walls of the drawer. In some embodiments, at least one open area is formed in one or more of the lateral walls of the drawer. The one or more open areas may be formed adjacent to or proximate to one or more selective spacing elements. One or more flexible heating elements may extend through the one or more open areas positioned adjacent to the selective spacing elements when the drawer is in the closed position.

In one example, each of at least two lateral walls of the drawer includes one selective spacing element and one open area. The heating element comprises a flexible heating element having two heating strips positioned on opposite sides of the cartridge. Each heating strip is configured to be moved by the selective spacing element as the drawer is moved between the open and closed position. Each heating strip is configured to contact or be proximate to the cartridge through a respective open area when the drawer is in the closed position.

In some embodiments, one or more airflow apertures may be formed in the drawer to allow air or aerosol to pass through. For example, airflow apertures may allow aerosol to flow out of the cartridge receptacle.

The aerosol-generating device may further include a cartridge disposal system. The cartridge disposal system may be configured to eject the cartridge from the cartridge receptacle when the cartridge is released and may be configured to receive the released cartridge in a container. In some embodiments, the cartridge may be discarded in a vertical drop when the drawer is horizontally moved away, or moved to an open position, to load a new cartridge.

Reference will now be made to the drawings, which depict one or more embodiments described in this disclosure. However, it will be understood that other embodiments not depicted in the drawings fall within the scope and spirit of this disclosure. Like numbers used in the figures refer to like components. The use of different numbers to refer to components in different figures is not intended to indicate that the different numbered components cannot be the same or similar to other numbered components. The figures are presented for purposes of illustration and not limitation. Schematic drawings presented in the figures are not necessarily to scale.

Figure 1A:
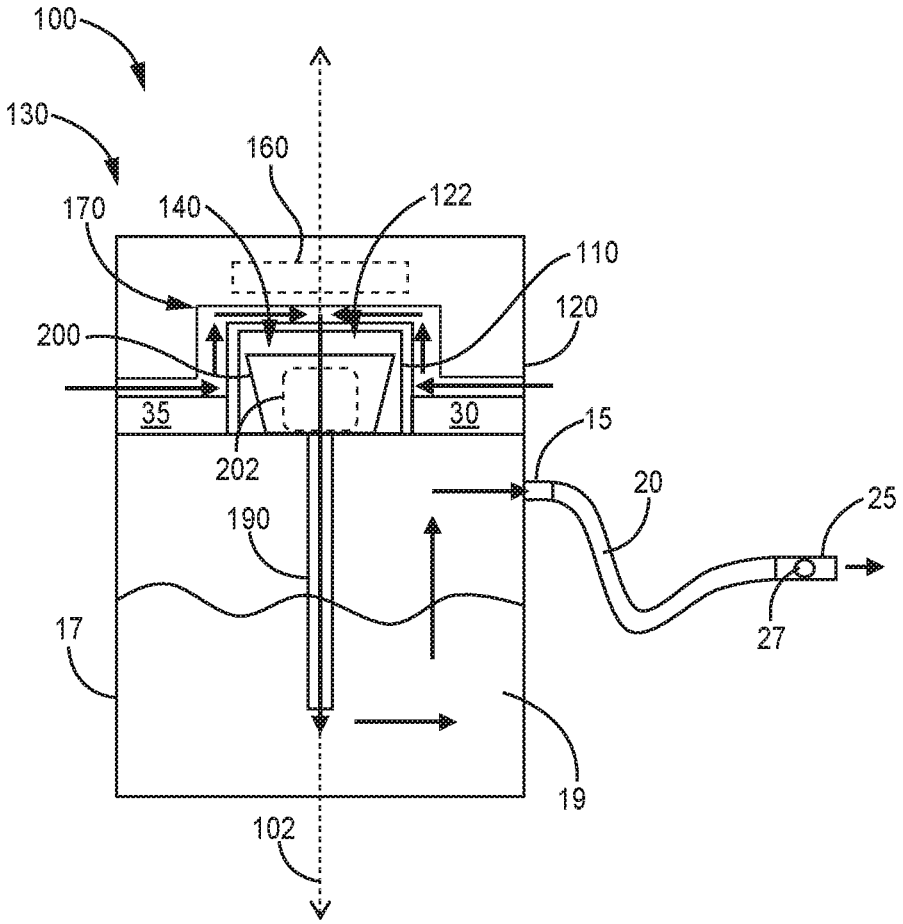
FIGS. 1A and 1B are schematic front and side sectional views of a shisha device comprising a drawer.
Figure 1B:
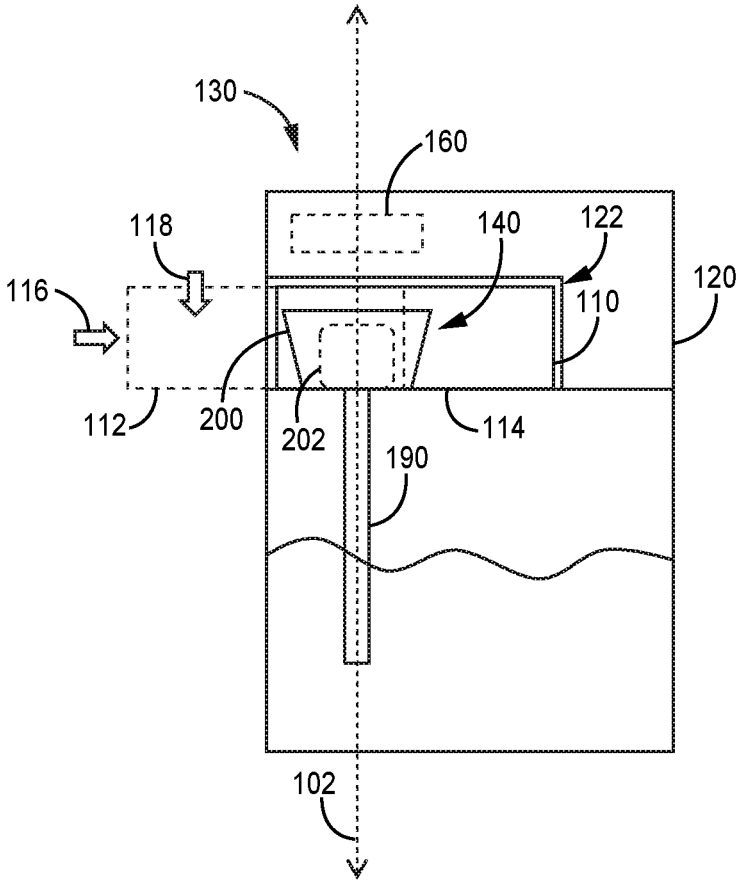

FIGS. 1A and 1B show schematic sectional views of an example of an aerosol-generating device 100, such as a shisha device, comprising a drawer 110. FIG. 1A shows a front view, and FIG. 1B shows a side view. The device 100 includes a vessel 17 defining an interior volume configured to contain liquid 19 and defining a headspace outlet 15 above a fill level for the liquid 19. The liquid 19 preferably includes water, which may optionally be infused with one or more colorants, one or more flavorants, or one or more colorants and one or more flavorants. For example, the water may be infused with one or both of botanical infusions and herbal infusions.

The device 100 also includes an aerosol-generating element 130 and a housing 120. A longitudinal axis 102 may be defined extending between the housing 120 of the aerosol-generating element 130 and the vessel 17. The aerosol-generating element 130 including the housing 120 has a drawer receptacle 122. The drawer receptacle 122 is configured to receive the drawer 110.

Figure 3B:
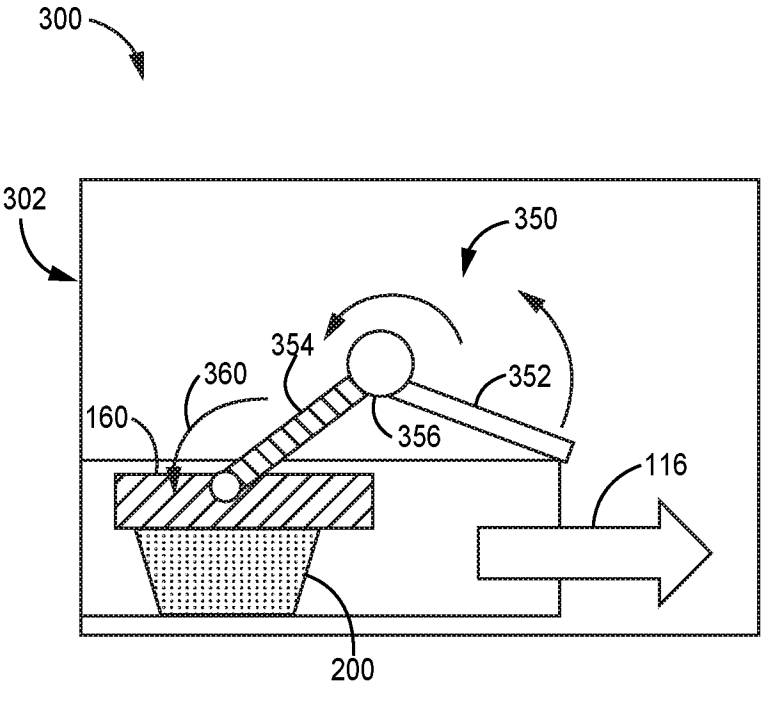
FIGS. 3A and 3B are schematic views of a first example of a shisha device having a first repositioning assembly.
Figure 3A:
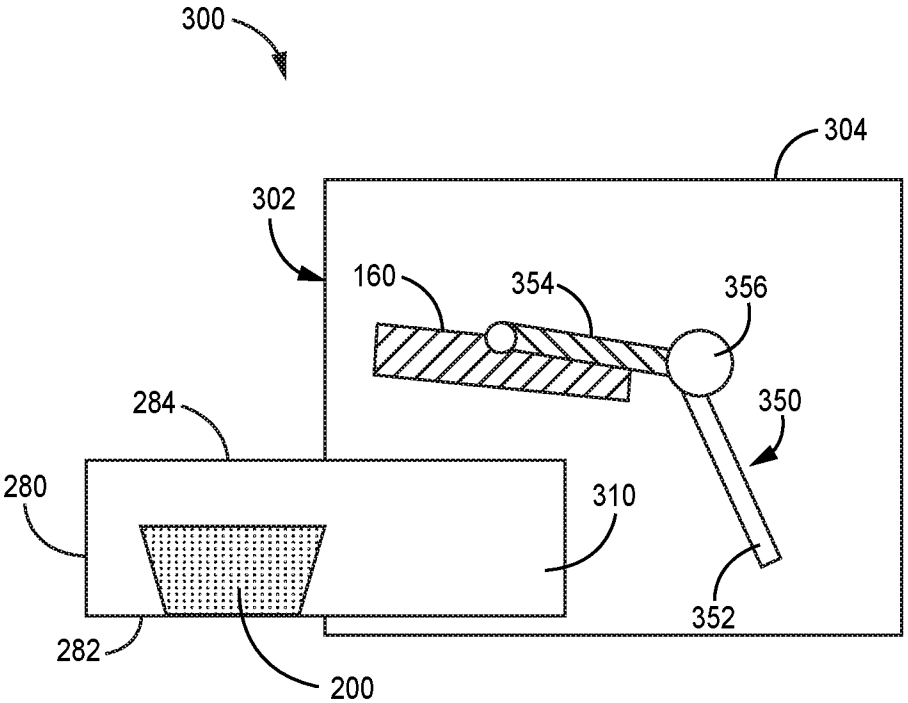

The drawer 110 may include one or more lateral walls, a bottom wall, and an optional top wall (see FIGS. 3A and 3B). The drawer 110 includes a cartridge receptacle 140 configured to receive a cartridge 200 comprising an aerosol-forming substrate 202. The cartridge 200 is receivable in a second direction 118 into the cartridge receptacle 140 of the drawer 110. The drawer 110 may be movable from an open position 112 to a closed position 114 in a first direction 116 illustrated by an arrow. The cartridge 200 may be released from the cartridge receptacle 140 in response to the drawer 110 being moved from the closed position 114 to the open position 112.

The exterior of the body of the cartridge 200 has an asymmetrical shape. As illustrated, the cartridge 200 has a frustoconical shape. The interior of the cartridge receptacle 140 has a complementary asymmetrical shape, such as a frustoconical shape, to facilitate a particular position or orientation of the cartridge 200 when received in the cartridge receptacle.

The aerosol-generating element 130 may also include a heating element 160. The aerosol-generating element 130 also includes an air inlet channel 170 that draws air into the device 100. The heating element 160 may be activated in response to user input or in response to sensor data. The heating element 160 may be moved from a non-heating position to a heating position by a repositioning assembly (see FIGS. 3A-8B). The repositioning assembly may use the mechanical motion of the drawer 110 to power movement of the heating element 160 or may use sensor data to initiate movement of the heating element.

In some embodiments, portion of the air inlet channel 170 is formed by the heating element 160 to heat the air before the air enters the cartridge receptacle 140. The pre-heated air then enters the cartridge 200, which is also heated by heating element 160, to carry aerosol generated by the aerosol former and the aerosol-forming substrate. The air exits an outlet of the aerosol-generating element 130 and enters a conduit 190.

The conduit 190 carries the air and aerosol into the vessel 17 below the level of the liquid 19. The air and aerosol may bubble through the liquid 19 and exit the headspace outlet 15 of the vessel 17. A hose 20 may be attached to the headspace outlet 15 to carry the aerosol to the mouth of a user. A mouthpiece 25 may be attached to, or form a part of, the hose 20. An exemplary air flow path of the device, in use, is depicted by thick arrows in FIG. 1A.

The mouthpiece 25 may include an activation element 27. The activation element 27 may be a switch, button or the like, or may be a puff sensor or the like. The activation element 27 may be placed at any other suitable location of the device 100. The activation element 27 may be in wireless communication with the control electronics 30 to place the device 100 in condition for use or to cause control electronics to activate the heating element 160; for example, by causing power supply 35 to energize the heating element 160.

The control electronics 30 and power supply 35 may be located in any suitable position of the aerosol-generating element 130, including locations other than the bottom portion of the element 130 as depicted in FIG. 1A. The control electronics 30 may include a motor operably coupled to the drawer 110 to move the drawer relative to the housing 120. The control electronics 30 may include a cooling system configured to cool the drawer.

Figure 2A:
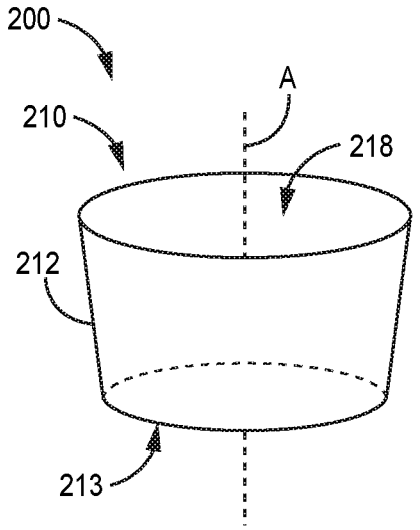
FIGS. 2A and 2B are schematic top and bottom perspective views, respectively, of the body of a shisha cartridge for use in the shisha device of FIG. 1 according to an embodiment.
Figure 2B:
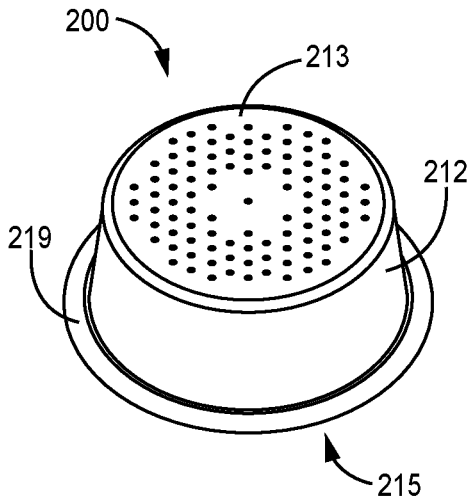

Referring now to FIGS. 2A and 2B, various embodiments of the body 210 of the cartridge 200 are shown. The body 210 may include a lateral wall 212, a top wall 215, and a bottom wall 213 defining a cavity 218. The lateral wall 212 may be cylindrical or frustoconical, as shown. FIG. 2A shows the body 210 without a top wall 215, showing the cavity 218 inside the body. The body 210 may define a center axis A extending through the body 210. As shown in FIG. 2B, the top may comprise a flange 219 that extends from the lateral wall 212. The flange 219 may rest on shoulder of the cartridge receptacle of the aerosol-generating device so that cartridge 200 may be readily removed from the receptacle after use by grasping the flange.

FIGS. 3A and 3B show schematic sectional side views of an example of an aerosol-generating device 300 including an aerosol-generating element 302. The aerosol-generating element 302 includes a housing 304, a drawer 310, and a repositioning assembly 350. The repositioning assembly 350 is coupled to the heating element 160 and the housing 304. The cartridge 200 is receivable into the drawer 310.

The drawer 310 includes one or more lateral walls 280, a bottom wall 282, and an optional top wall 284. The lateral walls 280 may include one or more side walls, a front wall, and a back wall. As illustrated, the drawer 310 includes one or more lateral walls 280 and a bottom wall 282.

The repositioning assembly 350 moves the heating element 160 in a repositioning direction 360, which is different than a first direction 116 used to move the drawer 310 from an open position to a closed position. The repositioning assembly 350 rotates the heating element 160 into contact with or in proximity to the cartridge 200. The repositioning assembly 350 is configured to use the mechanical motion of the drawer 310 to power movement of the heating element 160.

The repositioning assembly 350 includes a first arm 352 positioned in the path of the drawer 310, a second arm 354 coupled to the heating element, and a pivot joint 356 coupled to the housing 304 between the first arm and the second arm. When moving from the open position (see FIG. 3A) to the closed position (see FIG. 3B), the drawer may push the first arm 352 to rotate the second arm 354 about the pivot joint 356, which may move the heating element 160 toward the cartridge 200 and into the heating position as seen in FIG. 3B. The pivot joint 356 may maintain the same or substantially the same angle between the first arm 352 and the second arm 354. The repositioning assembly 350 may be biased, for example, using a spring, such that when the drawer 310 is moved from the closed position to the open position, the second arm 354 rotates about the pivot joint 356 to move the heating element 160 away from the cartridge 200 and into the non-heating position shown in FIG. 3A.

Figure 4B:
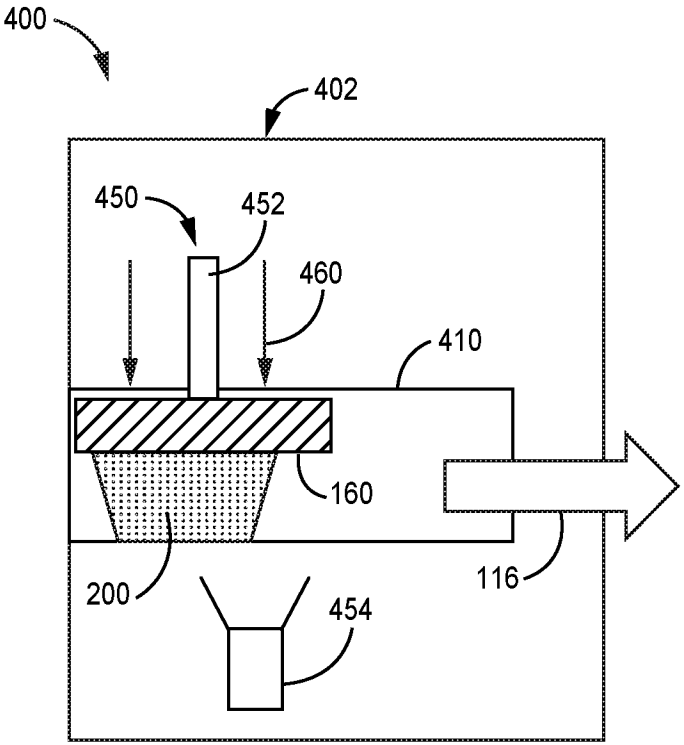
FIGS. 4A and 4B are schematic views of a second example of a shisha device having a second repositioning assembly.
Figure 4A:
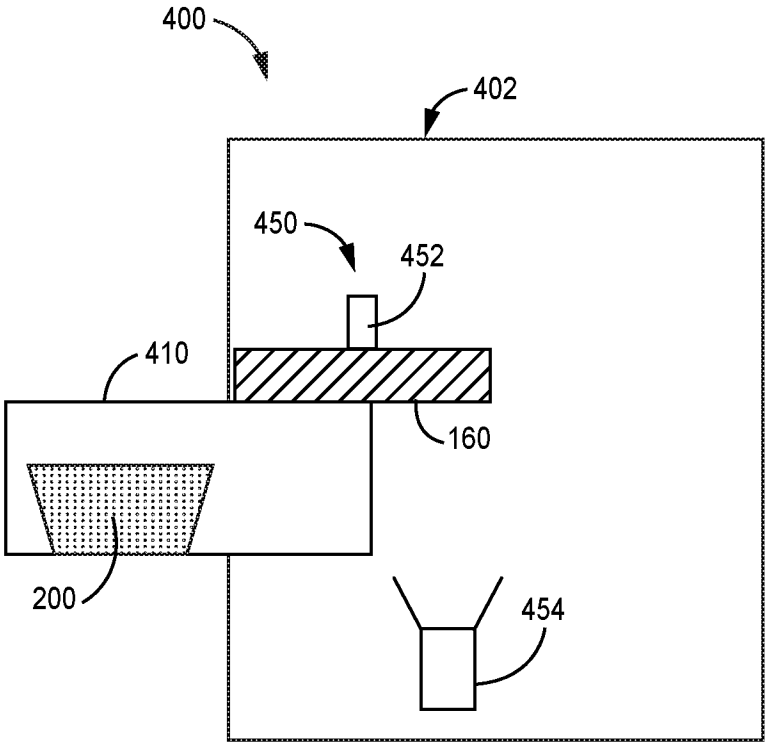

FIGS. 4A and 4B show schematic sectional side views of an example of an aerosol-generating device 400 including an aerosol-generating element 402. The aerosol-generating device 400 is like aerosol-generating device 300 of FIGS. 3A and 3B except that aerosol-generating device 400 includes a different repositioning assembly 450.

The repositioning assembly 450 includes a piston 452 and a presence sensor 454 configured to reposition the heating element 160. The presence sensor 454 may include any suitable sensor, such as a laser sensor, an infrared (IR) sensor, or a Hall effect sensor. The repositioning assembly 450 moves the heating element 160 in a repositioning direction 460, which is different than a first direction 116 used to move the drawer 410 from an open position to a closed position. As illustrated, the repositioning direction 460 is orthogonal to the first direction 116. The repositioning direction 460 along the piston 452 may be described as longitudinal movement. The repositioning assembly 450 linearly translates the heating element 160 into contact with or in proximity to the cartridge 200.

The presence sensor 454 is positioned to detect when the drawer 410 is in the closed position (see FIG. 4B). Activation of the presence sensor 454 triggers the piston 452 to push the heating element 160 toward the cartridge 200 into a heating position in contact with or in proximity to the cartridge 200. A pressure sensor may be operably coupled to the piston 452 to detect pressure being placed on the cartridge 200 by the piston. Activation of the pressure sensor may stop the movement of the piston 452.

Figure 5:
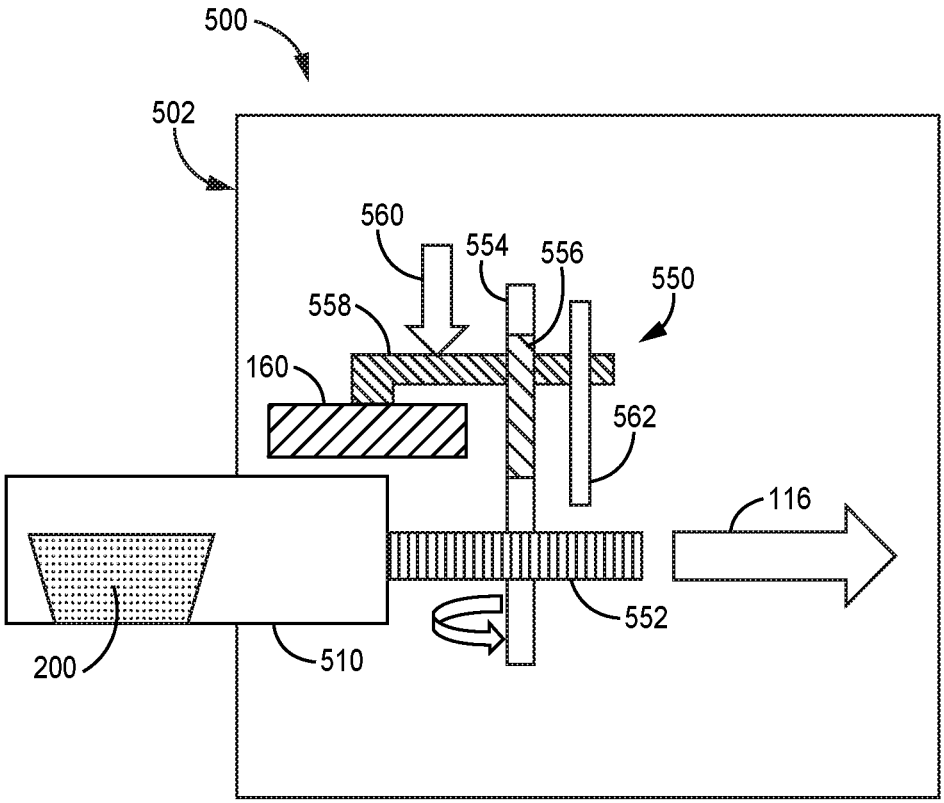
FIG. 5 is a schematic view of a third example of a shisha device having a third repositioning assembly.

FIG. 5 shows a schematic sectional side view of an example of an aerosol-generating device 500 including an aerosol-generating element 502. The aerosol-generating device 500 is like aerosol-generating device 400 of FIGS. 4A and 4B except that aerosol-generating device 500 includes a different repositioning assembly 550.

The repositioning assembly 550 includes one or more gears configured to reposition the heating element 160. The repositioning assembly 550 moves the heating element 160 in a repositioning direction 560, which is different than the first direction 116 used to move the drawer 510 from an open position to a closed position. As illustrated, the repositioning direction 560 is orthogonal to the first direction 116.

The drawer 510 includes a gear-like surface 552, which may engage or connect to, a rotating axle 554 of mating female gears. Movement of the drawer 510 along the first direction 116 rotates the axle 554 around an axis. The axle 554 includes a threaded connection 556 with a cantilever 558. The cantilever 558 is connected to the heating element 160. The cantilever 558 is prevented from rotating by being connected to a fixed tube 562, which may extend through the cantilever. The rotation of the axle 554 from movement of the drawer 510 in the first direction 116 causes the cantilever 558 to move closer to the cartridge 200 in the repositioning direction 560. Conversely, rotation of the axle 554 from movement of the drawer 510 in the opposite direction from the closed position to the open position causes the cantilever 558 to move away from the cartridge 200.

Figure 6B:
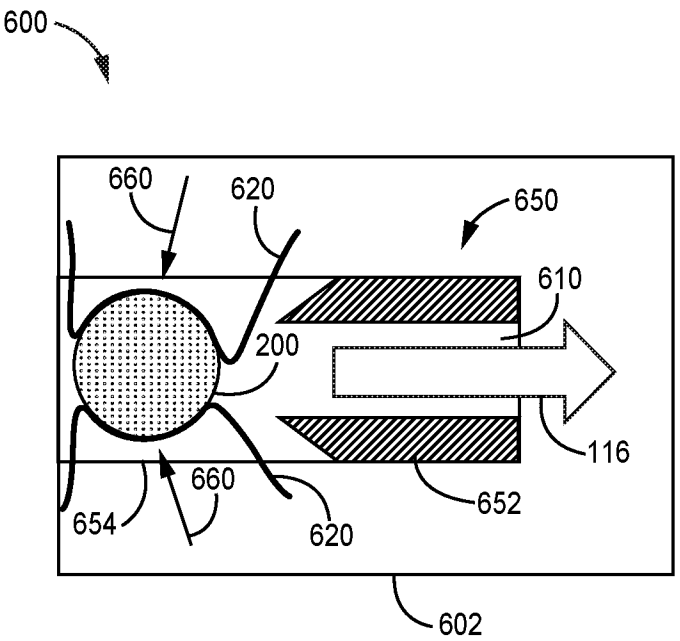
FIGS. 6A and 6B are schematic views of a fourth example of a shisha device having a fourth repositioning assembly.
Figure 6A:
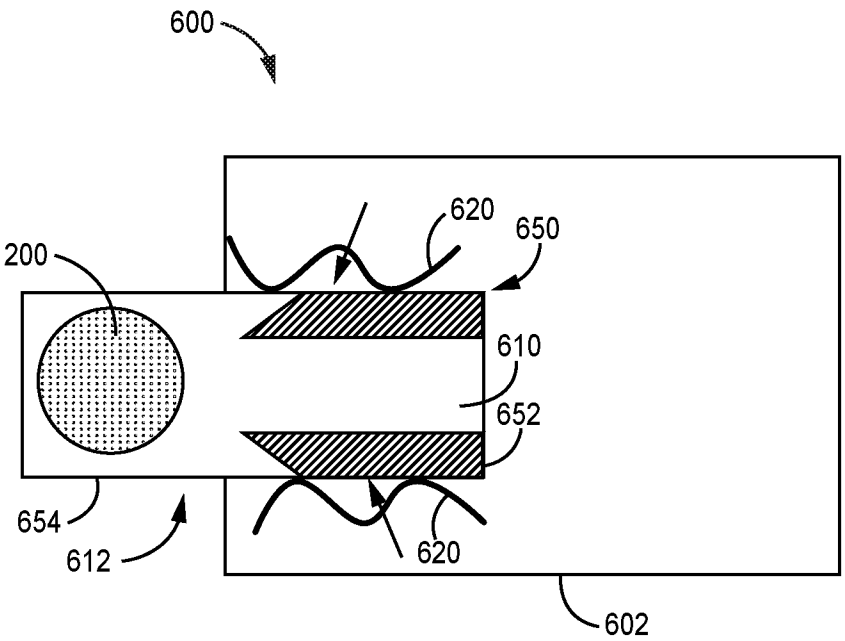

FIGS. 6A and 6B show schematic sectional top views of an example of an aerosol-generating device 600 including an aerosol-generating element 602. The aerosol-generating element 602 includes a heating element 620. The heating element 620 is a flexible heating element. As illustrated, the heating element 620 includes two heating strips. The heating strips are biased toward the cartridge 200 to be in contact with or in proximity with the cartridge in the heating position.

The drawer 610 includes two side walls 612. The repositioning assembly 650 includes two selective spacing elements 652 configured to move the heating element 620 away from the cartridge 200 when the drawer 610 moved from the closed position to the open position (see FIG. 6A). The selective spacing elements 652 may at least partially form the side walls 612 or may be coupled to the side walls. When the drawer 610 is moved from the open position to the closed position in the first direction 116, the heating element 620 is allowed to pass through open areas 654 in the side walls 612 and contact or be proximate to the cartridge 200 (see FIG. 6B). The heating element 620 moves inwardly in the repositioning direction 660, for example, due to a spring-like bias of the heating strips. The selective spacing elements 652 have tapered ends to facilitate moving the heating strips away from or allowing the heating strips to move toward the cartridge 200.

Figure 7:
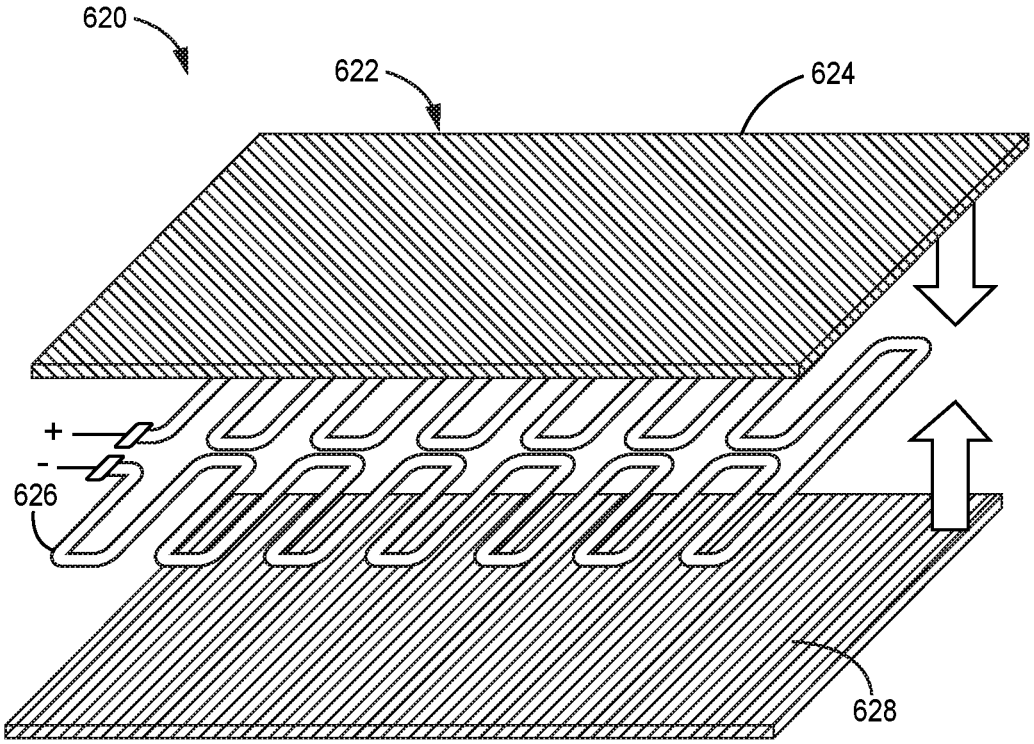
FIG. 7 is a schematic perspective view of one example of a heating element used in the shisha device of FIGS. 6A and 6B.

FIG. 7 shows a schematic exploded view of one example of one heating strip 622 of the heating element 620. The heating element 620 comprises three layers of material. As illustrated, the heating element 620 includes a first high heat resistance layer 624, a heating layer 626, and a second high heat resistance layer 628. The heating layer 626 may be positioned between the first and second high heat resistance layers 624, 628.

The first high heat resistance layer 624 is positioned on the side of the heating layer 626 that is closer to the cartridge. The material used to form the first high heat resistance layer 624 has a high thermal conductivity. The high heat resistance layer includes a rigid or deflectable, or spring-like, part to help bias, or position, the heating layer 626 in direct contact with or proximate to the cartridge in the heating position of the heating element.

The heating layer 626 may be formed of a thin line of resistance heating material, such as a stainless steel wire. In some embodiments, the heating layer may comprise woven metal wires. The heating layer 626 is operably couplable to an electrical circuit and converts electrical power into heat.

The second high heat resistance layer 628 is positioned on the side of the heating layer 626 that is opposite to the first high heat resistance layer 624. The material used to form the second high heat resistance layer 628 has a low thermal conductivity or a lower than the thermal conductivity than the material of the first high heat resistance layer 624.

Figure 8A:
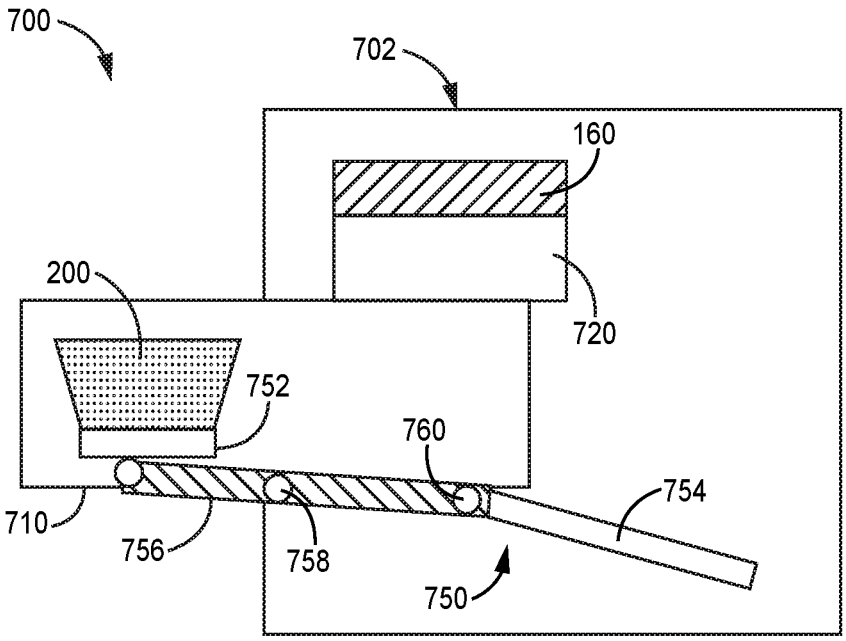
FIGS. 8A and 8B are schematic views of a fifth example of a shisha device having a fifth repositioning assembly configured to move the cartridge.
Figure 8B:
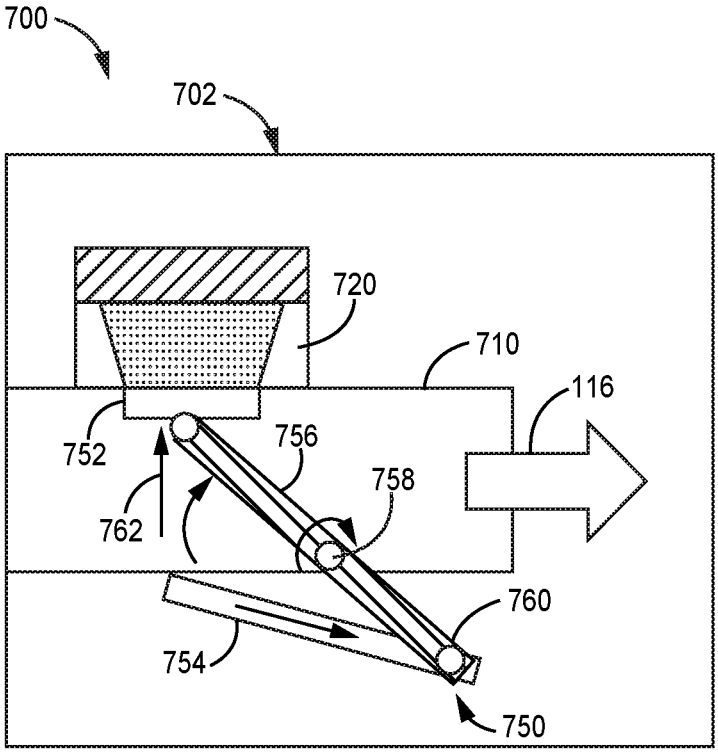

FIGS. 8A and 8B show schematic sectional side views of one example of an aerosol-generating device 700 including an aerosol-generating element 702. The aerosol-generating device 700 is like aerosol-generating device 300 of FIGS. 3A and 3B except that aerosol-generating device 700 includes a different repositioning assembly 750.

The aerosol-generating element 702 includes a heating chamber 720 and a repositioning assembly 750. The repositioning assembly 750 includes a platform extendable into the cartridge receptacle of the drawer 710 to move the cartridge 200 into a heating position at least partially into the heating chamber 720 in response to the drawer moving from the open position to the closed position in the first direction 116.

The repositioning assembly 750 also includes a fixed cam 754, a rail 756 coupled to the platform 752, a pivot joint 758 coupled to the housing of the aerosol-generating element 702, and a slidable connection 760 between the fixed cam and the rail. Moving the drawer 710 in the first direction 116 causes the slidable connection 760 to slide along the fixed cam 754. As the end of the rail 756 connected to the slidable connection 760 lowers, the opposite end connected to the platform 752 rises in a repositioning direction 762. The platform 752 raises the cartridge 200 at least partially into the heating chamber 720 (see FIG. 8B). The heating element 160 is positioned in the heating chamber 720.

Thus, cartridge insertion systems for aerosol-generating devices are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in the mechanical arts, chemical arts, and aerosol-generating article manufacturing or related fields are intended to be within the scope of the following claims.

The invention claimed is:

1. An aerosol-generating device comprising:

a housing comprising a drawer receptacle;

a drawer moveably coupled to the housing and receivable in the drawer receptacle, the drawer defining a cartridge receptacle to removably receive a cartridge comprising an aerosol-forming substrate, wherein the drawer is movable between an open position and a closed position in a first direction; and a heating element configured for heating the aerosol-forming substrate in a cartridge when a cartridge is received in the cartridge receptacle and the drawer is in the closed position, wherein the aerosol-generating device is configured to translate at least one of the heating element and the cartridge received in the cartridge receptacle in a repositioning direction to approximate the heating element and the cartridge such that the at least one heating element is adjacent or proximate the cartridge but does not penetrate the cartridge, in response to moving the drawer from the open position to the closed position, wherein the repositioning direction is different to the first direction.

2. The aerosol-generating device according to claim 1, wherein the cartridge receptacle of the drawer is configured to receive the cartridge in a second direction when the drawer is in the open position, wherein the second direction is different to the first direction.

3. The aerosol-generating device according to claim 1, wherein a longitudinal axis of the aerosol-generating device is defined to extend between the housing and a vessel defining a headspace, wherein the first direction is orthogonal to the longitudinal axis.

4. The aerosol-generating device according to claim 1, wherein the aerosol-generating device is configured to permit the cartridge to be released from the cartridge receptacle of the drawer in response to moving the drawer from the closed position to the open position.

5. The aerosol-generating device according to claim 1, wherein the aerosol-generating device further comprises a motor configured to move the drawer from the open position to the closed position or from the closed position to the open position.

6. The aerosol-generating device according to claim 1, further comprising a repositioning assembly coupled to the heating element, the repositioning assembly configured to move the heating element into a heating position in response to the drawer moving from the open position to the closed position.

7. The aerosol-generating device according to claim 6, wherein the repositioning assembly is configured to:

linearly translate the heating element into contact with or in proximity to the cartridge.

8. The aerosol-generating device according to claim 6, wherein the repositioning assembly uses mechanical motion of the drawer to power movement of the heating element or uses sensor data to initiate movement of the heating element.

9. The aerosol-generating device according to claim 6, wherein the repositioning assembly comprises one or more gears.

10. The aerosol-generating device according to claim 1, wherein the heating element comprises a flexible material and the heating element is configured to move into a heating position in response to the drawer moving from the open position to the closed position.

11. The aerosol-generating device according to claim 10, wherein the drawer comprises a selective spacing element configured to allow the heating element to move into the heating position when the drawer is in the closed position and to move the heating element away from the cartridge when the drawer is in the open position.

12. The aerosol-generating device according to claim 10, wherein the heating element comprises a multi-layer heating strip comprising at least a heating layer and a thermally insulating layer.

13. The aerosol-generating device according to claim 1, wherein one or more air flow apertures are formed in at least one of the drawer and the heating element.

14. The aerosol-generating device according to claim 1, wherein the aerosol-generating device is a shisha device, further comprising:

a vessel having a liquid fill level and defining a headspace above the liquid fill level;

an aerosol conduit for conveying aerosol from the cartridge receptacle to below the liquid fill level in the vessel; and an outlet in communication with the headspace.

* * * * *